United States Patent [19]

Howard et al.

[11] 4,109,800

[45] Aug. 29, 1978

[54] MULTI-STAGE WELL-DRILLING MAST ASSEMBLY

[75] Inventors: James A. Howard; Roger Smith, Jr., both of Houston, Tex.

[73] Assignee: BJ-Hughes Inc., Long Beach, Calif.

[21] Appl. No.: 404,943

[22] Filed: Oct. 10, 1973

[51] Int. Cl.[2] ..... E21B 19/00

[52] U.S. Cl. ..... 214/2.5; 214/1 P

[58] Field of Search ..... 214/2.5, 1 P; 175/85

[56] References Cited

U.S. PATENT DOCUMENTS

| | | | |
|---|---|---|---|
| 3,177,944 | 4/1965 | Knights | 214/2.5 X |
| 3,280,920 | 10/1966 | Scott | 214/2.5 X |
| 3,336,991 | 8/1967 | Klem et al. | 214/2.5 X |
| 3,633,771 | 1/1972 | Woolslayer | 214/1 BD |
| 3,734,208 | 5/1973 | Otto | 214/2.5 |
| 3,851,770 | 12/1974 | Jenkins et al. | 214/2.5 |

*Primary Examiner*—Allen N. Knowles

[57] ABSTRACT

A multi-stage, well-drilling mast assembly, particularly adapted to mobile drilling platforms, such as drilling vessels, the assembly having a main stage mast and an auxiliary mast, both pivoted to the platform for swinging movements between horizontal and vertical positions. The main stage carries well pipe hoisting equipment, and the auxiliary stage carries rack equipment for vertically storing well pipe, and racker equipment for moving the well pipe between the rack and the center line of the mast assembly. Slings operated by the hoisting equipment swing the stages between horizontal and vertical positions. A low profile and a low center of gravity are achieved when the stages are horizontally disposed. The distribution of the weight of the hoist, the rack, and the rackers between the stages of the mast assembly provides a multi-stage mast assembly in which the individual stages may be conveniently swung between reclined and vertical, well-drilling positions.

20 Claims, 11 Drawing Figures

FIG. 1.
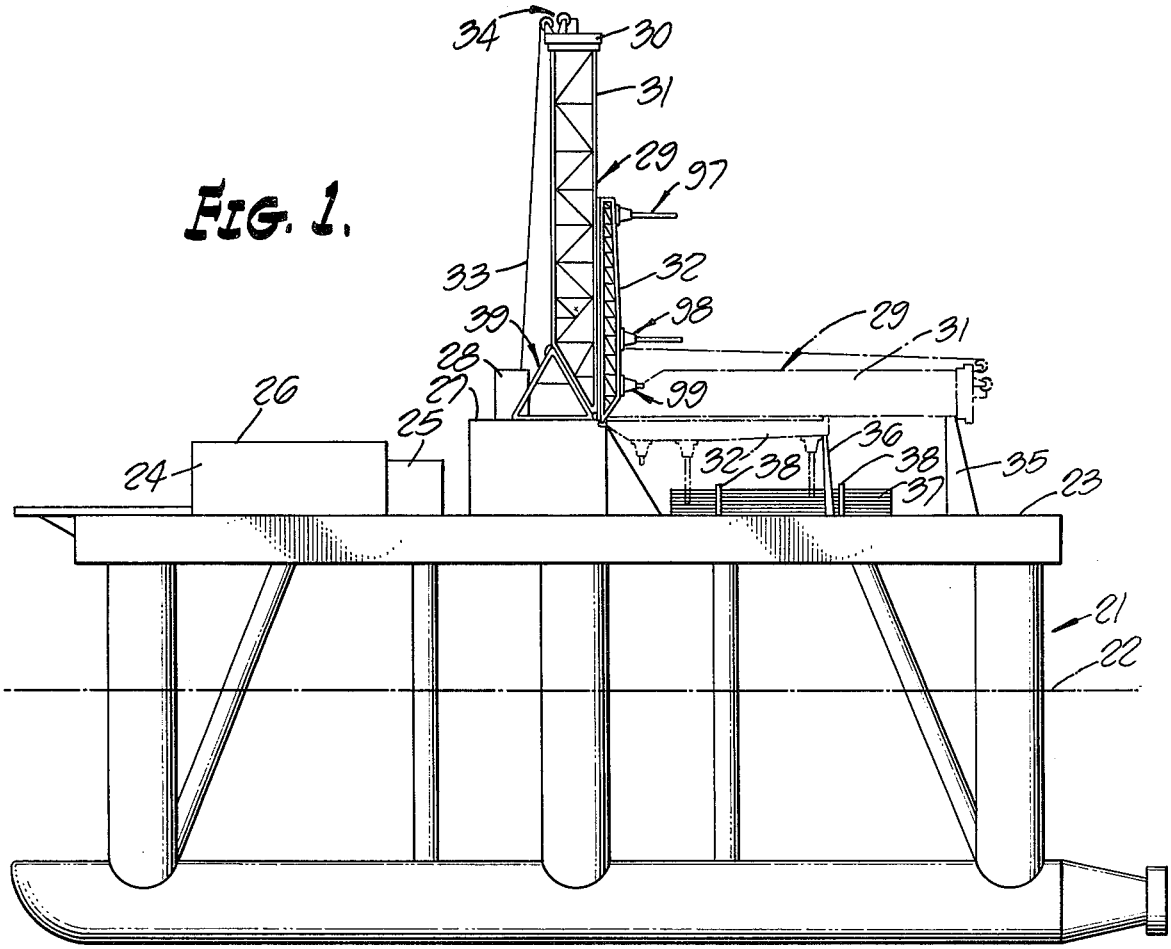
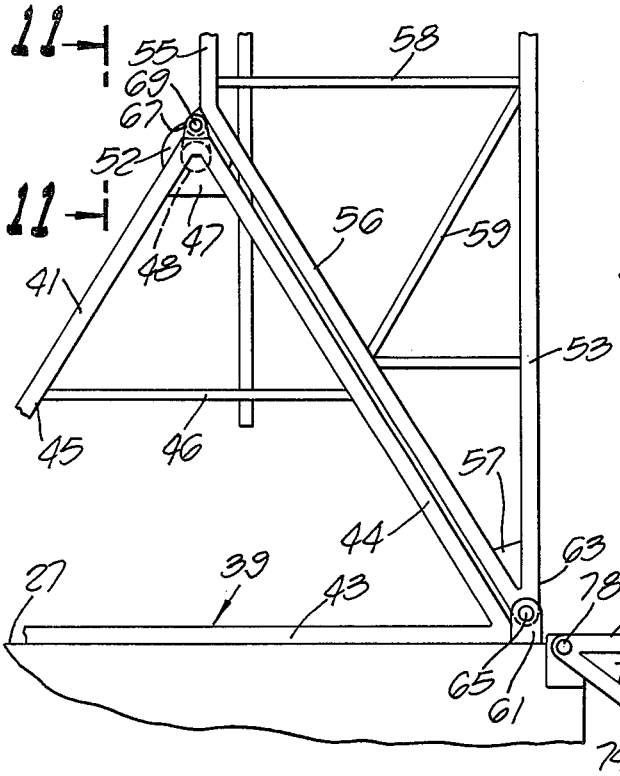
FIG. 10.
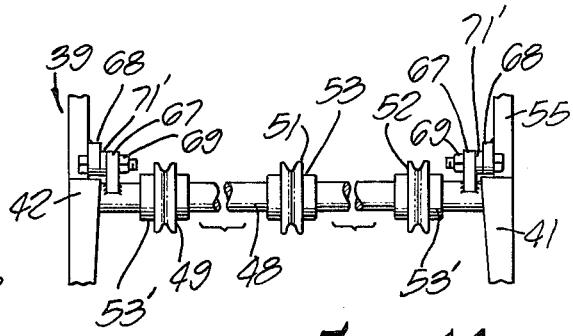
FIG. 11.

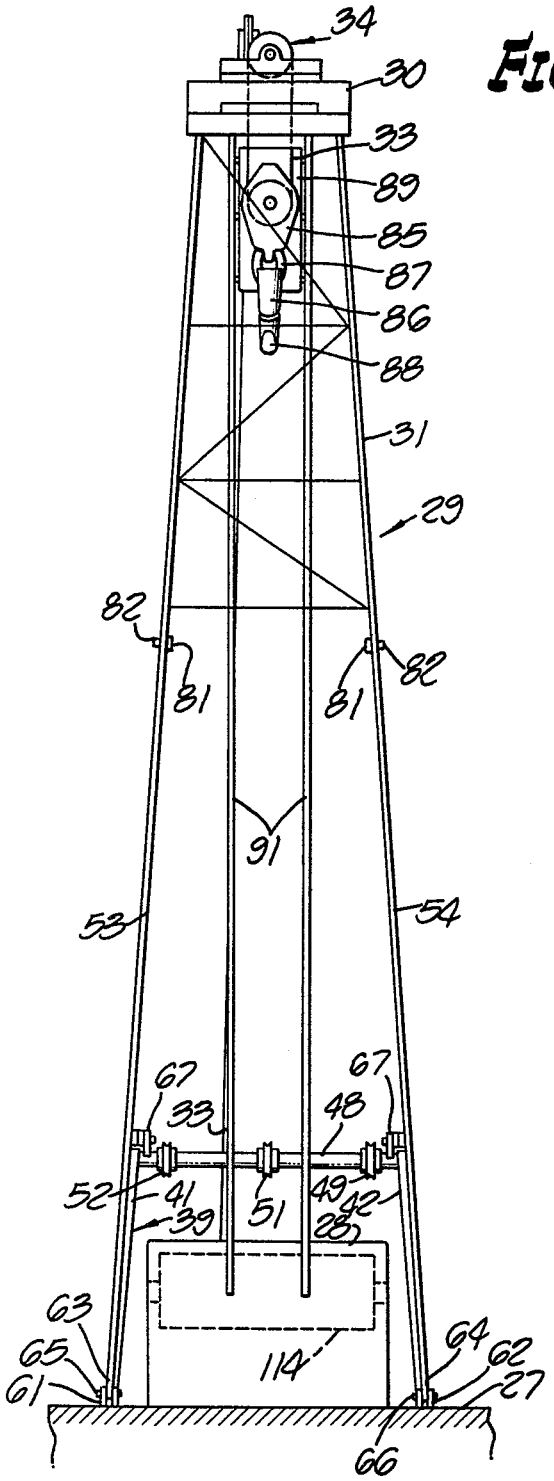
FIG. 8.
FIG. 9.
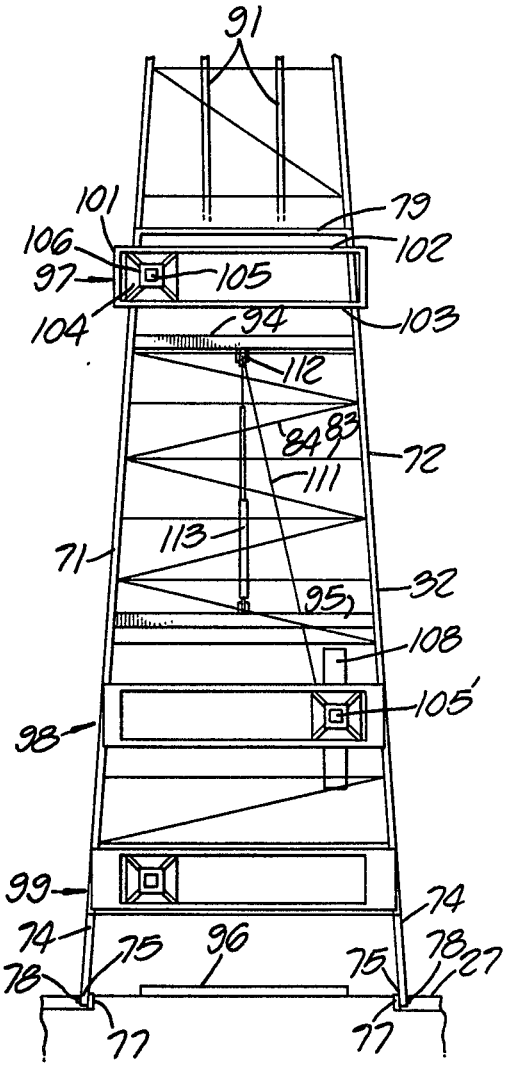

MULTI-STAGE WELL-DRILLING MAST ASSEMBLY

BACKGROUND OF THE INVENTION

1. Field of the Invention

This invention relates to a mast assembly or derrick structure for drilling wells, such as oil or gas wells. It is particularly useful when installed on a floating drilling platform, such as a drilling vessel, but its use is not so limited, as many of its advantages are realized in land-based installations, or in mobile equipment for use on land.

2. Description of the Prior Art

Marine drilling rigs are known in which a mast or derrick is pivoted to a floating platform for swinging movements between a horizontal position, in which the floating rig is readily moved between drilling locations or sites, and a vertical position in which the drilling operation is performed. One such known rig is disclosed in U.S. Pat. No. 2,475,933 issued July 12, 1949, "Marine Drilling Rig", Woolslayer et al. Such masts are very heavy and require great power to raise them from the horizontal to the upright position.

If a hook assembly and traveling block guiding apparatus were to be added to the hoisting equipment, and if a vertical pipe rack and racker equipment were to be added to the mast or derrick, the weight of the assembly would become excessive, and it would, therefore, be impracticable to provide sufficient power to conveniently raise and lower the mast.

SUMMARY OF THE INVENTION

An object of the invention is to provide a drilling-mast assembly that has at least two stages that are horizontally disposed to provide a low profile and a low center of gravity, and that are conveniently swung to the upright positions for the drilling of a well. When this drilling mast assembly is provided on a mobile rig, seaworthiness or roadability as the case may be, is achieved, and the mobile rig may easily pass under bridges or other obstructions when the mast stages are reclined.

Another object of the invention is to provide such a multi-stage mast, the separately swingable stages of which each carries a part of the heavy derrick equipment, such as the crown block, the traveling block, the hook assembly, the traveling block guide and positioner, the fingerboard rack, and the racker carriages and arms.

The foregoing and other aims, objects and advantages of the invention, as will appear in or be evident from the following description of a preferred embodiment of the invention, are realized in a multi-stage, well-drilling mast comprising a platform; a first stage mast; means pivotally mounting said first stage mast on said platform for swinging movements between horizontal and upright positions; means for locking said first stage mast in upright position; a second stage mast; means pivotally mounting said second stage mast on said platform for swinging movements between an upright position adjacent to said first stage mast in its upright position and a horizontal position; and means for locking said second stage mast in upright position.

BRIEF DESCRIPTION OF THE DRAWINGS

In the drawings, in which like reference numerals refer to corresponding parts in the several views:

FIG. 1 is an elevational view of a semi-submersible marine drilling platform upon which is mounted and shown in erect position an exemplary multi-stage drilling mast in accordance with the invention, the drilling mast also being shown in retracted position in dotted lines;

FIG. 8 is a right-hand side view of the first stage of the multi-stage mast taken along the line 8—8 of FIG. 5, but with the elevating rigging removed;

FIG. 9 is a fragmentary view taken along the line 9—9 of FIG. 5, also with the elevating rigging removed;

FIG. 10 is a further enlarged view of a portion of the multi-stage mast as seen in FIG. 3; and FIG. 11 is a view taken along the line 11—11 of FIG. 10.

DESCRIPTION OF THE PREFERRED EMBODIMENT

Figure 2:
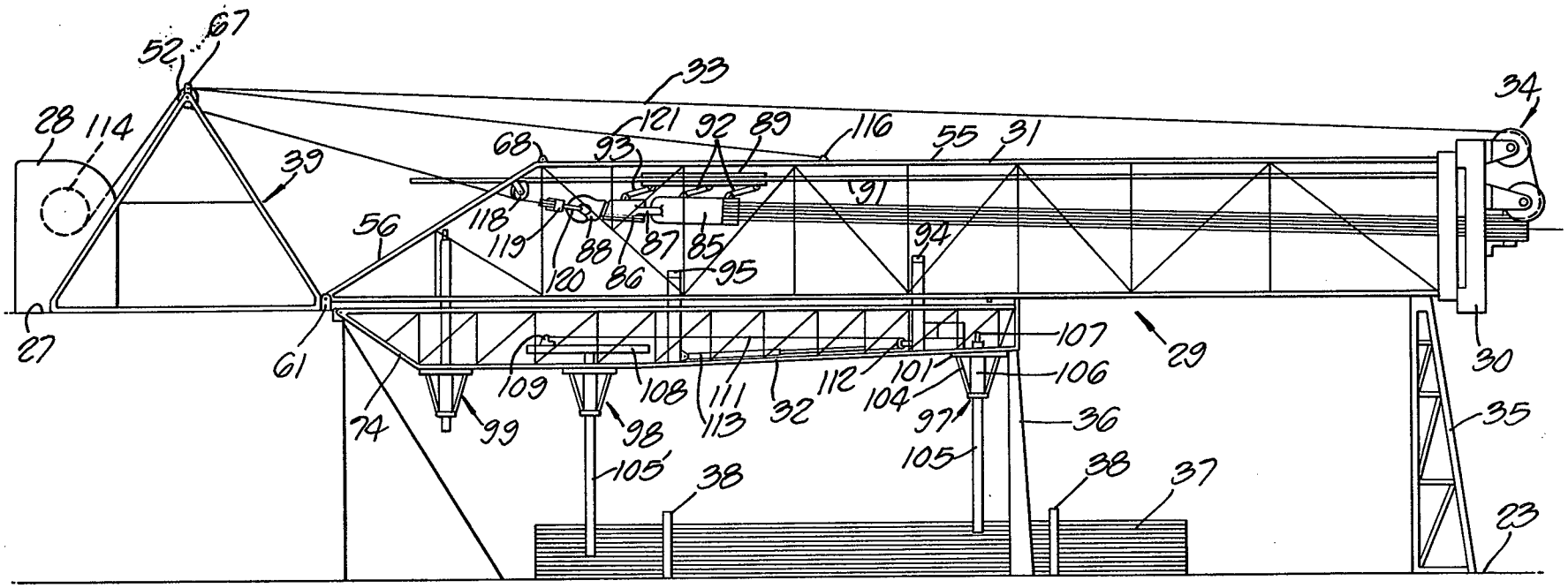
FIG. 2 is an enlarged elevational view of the multi-stage drilling mast in retracted position, and rigged for the raising of the first stage.

Referring to the drawings, particularly to FIG. 1, the semi-submersible drilling platform 21 shown is of a known type and is illustrated as being afloat on a body of water, the surface of which is indicated at 22. The platform has a main deck 23 upon which stand houses 24, 25 used for purposes of storage and shelter. The roof 26 of the house 24 provides a pad for the landing and take-off of a helicopter employed in transporting personnel and equipment between the platform and a land base.

An elevated drilling floor 27 is erected on the main deck and carries the usual drawworks 28. The floor also serves as a base for and supports a multi-stage drilling mast 29 that embodies the present invention. The mast has a first or main stage 31 and a second or auxiliary stage 32, the mast being shown in the upright or drilling position. A cable 33 leads from the drawworks over a crown block 34, mounted on a water table 30 atop the first stage 31, and thence to a traveling block, not shown in FIG. 1, but hereinafter described with reference to certain subsequent figures. As is customary, the drilling floor is equipped with a rotary table, not shown, and other drilling equipment usual to rotary drilling rigs. Holes, not shown, are provided in the drilling floor 27 and main deck 23 for the passage of the drill string, not shown, which, during the drilling operation, hangs from the drilling rig and extends to the floor of the body of water and into the earth below, all as well known in marine drilling technology.

As shown in dotted lines, the multi-stage mast is seen in its retracted and horizontal position in which the lower ends of both the first 31 and second 32 stages are supported by the drilling floor structure, with the upper end of the first stage 31 resting upon a vertical support 35 and the upper end of the second stage 32 resting upon another support 36. As shown, these supports are carried by the main deck 23.

A supply of drill pipe 37 is contained in a rack 38 on the deck 23.

Referring now to FIGS. 5, 8, 10 and 11, it is seen that an A-frame, designated by the general reference numeral 39, is carried by the drilling floor 27. The A-frame has a pair of horizontally spaced, upright, side frames 41, 42. The side frames 41, 42 are mirror images of each other, and a description of only the side frame 41 will suffice. The side frame 41 has a base rail 43, a front strut 44, and a rear strut 45, joined at their ends in a triangular configuration. A cross-brace 46 is secured between the front and rear struts and parallel to the base rail 43, and a gusset 47 is welded in the apex between the front and rear struts. The base rail is suitably fastened to the drilling floor 27.

Between the tops of the side frames 41, 42, a horizontal arbor 48 is welded. The arbor provides a structural member for the A-frame 39, and also serves to rotatably mount the sheaves 49, 51, 52. Collars 53' are fixed to the arbor to position the sheaves in spaced relation therealong.

Figure 5:
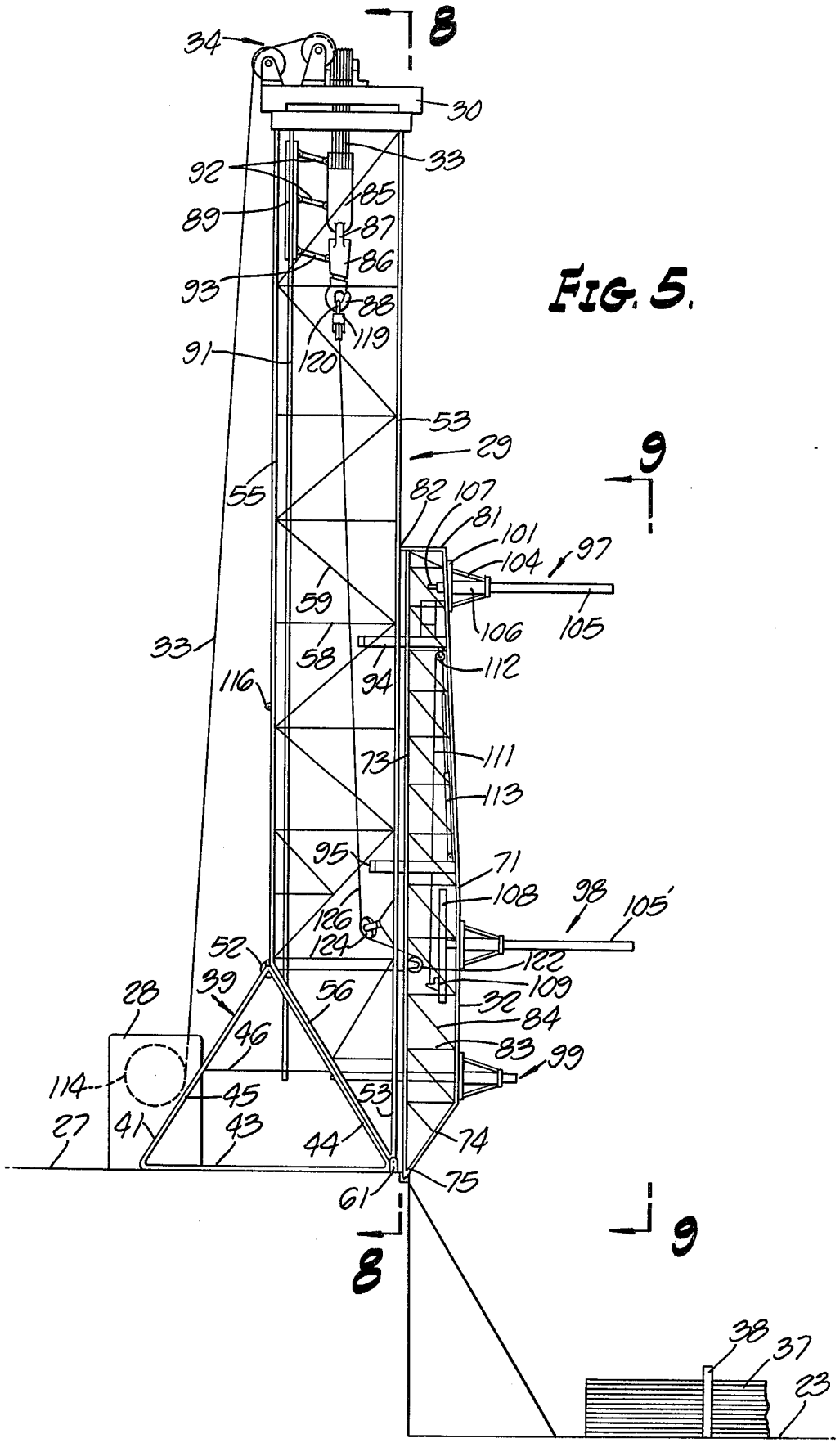
FIG. 5 is a view similar to FIG. 4, but with the first and second stages in erect position.

As best seen in FIGS. 5 and 8, the first or main stage 31 of the mast is a trusswork structure having four upright members or legs at the respective four corners thereof. Two of the upright members 52, 54 are at the front of the first stage, and the other two, one 55 of which seen in FIG. 5 are at the rear. The rear upright members 55 have downward extensions 56 bent at an angle to conform to and lie adjacent to the front struts 44 of the A-frame, previously described. The downward extensions 56 are joined to the respective front legs 53, 54 at the bottom of the first stage, and the joints are provided with gussets 57, as shown in FIG. 10. Cross braces 58 and sway braces 59 add rigidity and strength to the structure.

As best seen in FIGS. 8 and 10, a pair of laterally spaced, upstanding clevises 61, 62 are secured to the drilling floor 27 to receive the gussetted bottom portions 63, 64 of the first stage. These bottom portions are pivoted to the clevises by pivot pins 65, 66, about which the first stage may be swung to vertical and horizontal positions.

The first stage is releasably secured in its upright position by means shown in detail in FIGS. 10 and 11. Referring to these figures, it is seen that the arbor 48 has two upstanding lugs 67, 67 welded to it, each near an end of the arbor. Cooperating lugs 68, 68 are welded to the rear legs 55. Each pair of opposed lugs 67, 68 has a locking bolt 69 passing through aligned holes in the lugs. Washers 71', 71' are placed on the bolts and between the lugs. Thus, when the bolts are tightened, solid connections are made between the pairs of opposed lugs. When the bolts are removed, the first stage of the mast is free to be lowered to horizontal position, as is described later hereinafter.

Turning now to FIGS. 5, 9 and 10, it is seen that the second stage 32 is also a trusswork structure having four upright members or legs at the corners thereof. Two of these legs 71, 72 are at the front of the stage, and two 73, 73 are at the rear. Each of the front legs has a downward extension 74, 74 inclined rearwardly and joined to the respective rear legs 73 at their lower ends 75, 75. These lower ends are provided with gusset plates 76 (See FIG. 10) for strengthening the joints. A pair of laterally spaced pivot brackets 77, 77 are anchored to the drilling floor 27, and pivot pins 78, 78 are passed through aligned holes in the brackets 77, 77 and the lower ends 75, 75 of the second stage to pivotally mount the latter for movement between its erect and recumbent positions.

The top of the second stage has a horizontal frame including a transverse member 79 and spaced side members 81, 81, the inner ends of the latter, as seen in FIG. 8, being received between and adjacent to the front legs 53, 54 of the first stage, and releasably locked thereto by removable locking pins 82, 82. Cross-braces 83 and sway braces 84 extend between the legs of the second stage to add strength and rigidity to it.

Referring again to FIGS. 5 and 8, it is seen that the first or main stage 31 of the multi-stage mast of the invention carries the hoisting equipment. This equipment includes not only the crown block 34, previously referred to, but also a traveling block 85 suspended from the crown block by the wire-rope cable 33, mentioned hereinbefore. The traveling block is raised and lowered in the first stage by the drawworks 28 to move the drilling string (not shown) into and out of the well, as is conventional. A hook assembly 86 is suspended from the traveling block by a bail 87, and the assembly has a hood member 88 from which is suspended the load to be raised or lowered.

Block and hook positioning and guiding apparatus is also provided. In the illustrated embodiment, this apparatus has a carriage 89 vertically movable on a pair of parallel, vertical guide rails 91, 91 affixed to the first stage structure. A pair of vertically spaced, parallel links 92, 92 is pivoted to the carriage and the traveling block, and a third parallel link 93 is pivoted to the carriage and the hook assembly. Motor means, not shown, in the form of a piston-and-cylinder device, one end of which is attached to the carriage and the other end of which is attached to the traveling block, moves the traveling block and hook assembly from a position on the center line of the first stage, which is an extension of the center line of the well, to another position displaced to the rear of the center line, and selectively holds the traveling block and hook assembly in either of such positions. With this apparatus, drill pipe may be handled rapidly in making round trips for the purpose of replacing a worn drill bit, for example. This hoisting apparatus and its method of use are well known, per se, and are more fully disclosed in U.S. Pat. No. 3,507,405 issued Apr. 21, 1970, "Block and Hook Structure Positioning and Guiding Apparatus", Taylor L. Jones et al., to which reference is made.

Reverting now to FIGS. 5 and 9, it is seen that the second or auxiliary stage 32 of the mast of the invention carries the pipe storage racks and the equipment for racking and unracking the stands of drill pipe and the drill collars, and for transporting them to racked positions and positions over the rotary table and in line with the well bore.

The pipe storage and racker apparatus may be of the kind shown and described in U.S. Pat. No. 3,501,017 issued Mar. 17, 1970, "Finger Board and Racker Apparatus and Method", Noal E. Johnson et al, and in U.S. Pat. No. 3,561,811 issued Feb. 9, 1971, "Well Pipe Racker", John W. Turner, Jr., to which reference is made for a more complete disclosure.

In brief, the pipe storage equipment or rack includes a fingerboard 94 mounted on the second stage near the upper end thereof, an intermediate rack member 95, and a base 96 on the floor 27. Stands of pipe are received vertically in the rack, with their lower ends resting on the base 96, their upper ends received in slots (not shown) in the fingerboard 94, and their medial portions embraced in the intermediate rack member 95.

Further, and also in brief, the racker apparatus includes an upper racker 97, an intermediate racker 98, and a lower racker 99. The upper and lower rackers are identical in construction and operation, and the upper racker only will be described. The upper racker has a laterally extending, elongate frame 101 mounted on the front legs 71, 72 of the second stage 32. This frame provides upper and lower parallel guide rails 102, 103 on which a racker arm carriage 104 is mounted for transverse movement along the guide rails. The carriage is provided with a remotely controlled motor (not shown) for translating the carriage along the rails. A racker arm 105 is reciprocably carried in a tubular guide 106 on the carriage and mounted in the guide for forward and backward motion into and out of the first stage 31. The arm is moved in its tubular guide by another remotely controlled motor (not shown). At the inner end of the racker arm is mounted a racker head 107 which, as disclosed in the aforementioned U.S. Pat. No. 3,561,811 may be in the form of a claw for holding the upper end of a well pipe and moving it horizontally from place to place in the first stage 31 by effecting lateral movements of the carriage 104 and inward and outward movements of the racker arm 105.

The intermediate racker 98 is similar to the upper and lower rackers in the arrangement of the guide rails, the carriage with its tubular racker arm guide, and the reciprocable racker arm. However, the inner end of the racker arm 105' is provided with a vertically disposed head support and guide member 108 on which is mounted, for vertical movement, an intermediate racker head 109. This racker head is connected by a line 111 that passes over a sheave 112 to a hydraulic piston-and-cylinder motor 113, which is remotely controlled to raise and lower the intermediate racker head on the member 108. The intermediate racker head has a claw that grips a medial portion of a stand of well pipe and, operated in concert with the upper racker, transports the pipe to positions on the center line of the main stage and positions in the rack. The well pipe may be vertically manipulated by vertically moving the intermediate racker head 109.

Figure 3:
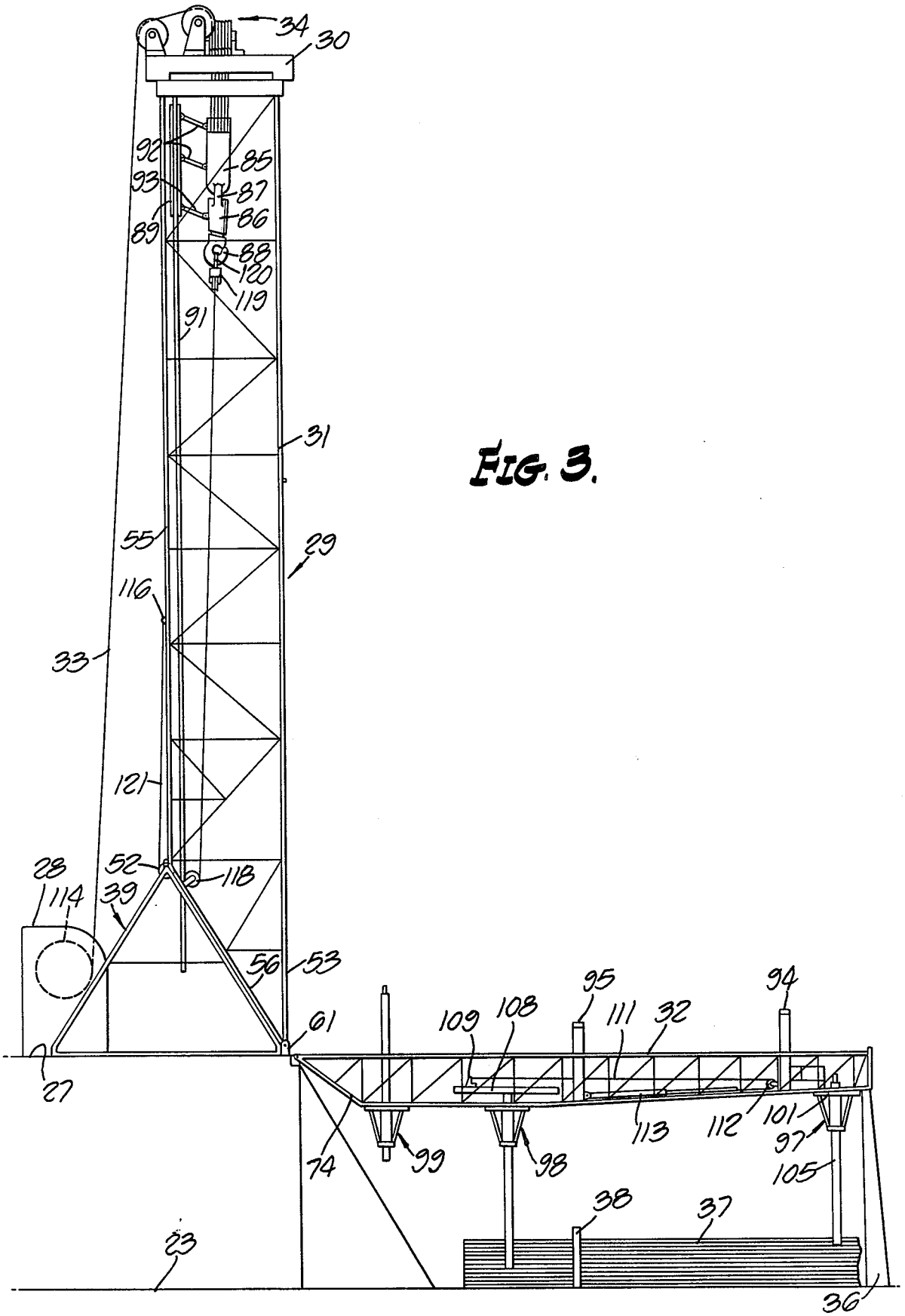
FIG. 3 is an elevational view, on the same scale as FIG. 2, of the multi-stage drilling mast with the first stage in erect position and the second stage in retracted position.
Figure 6:
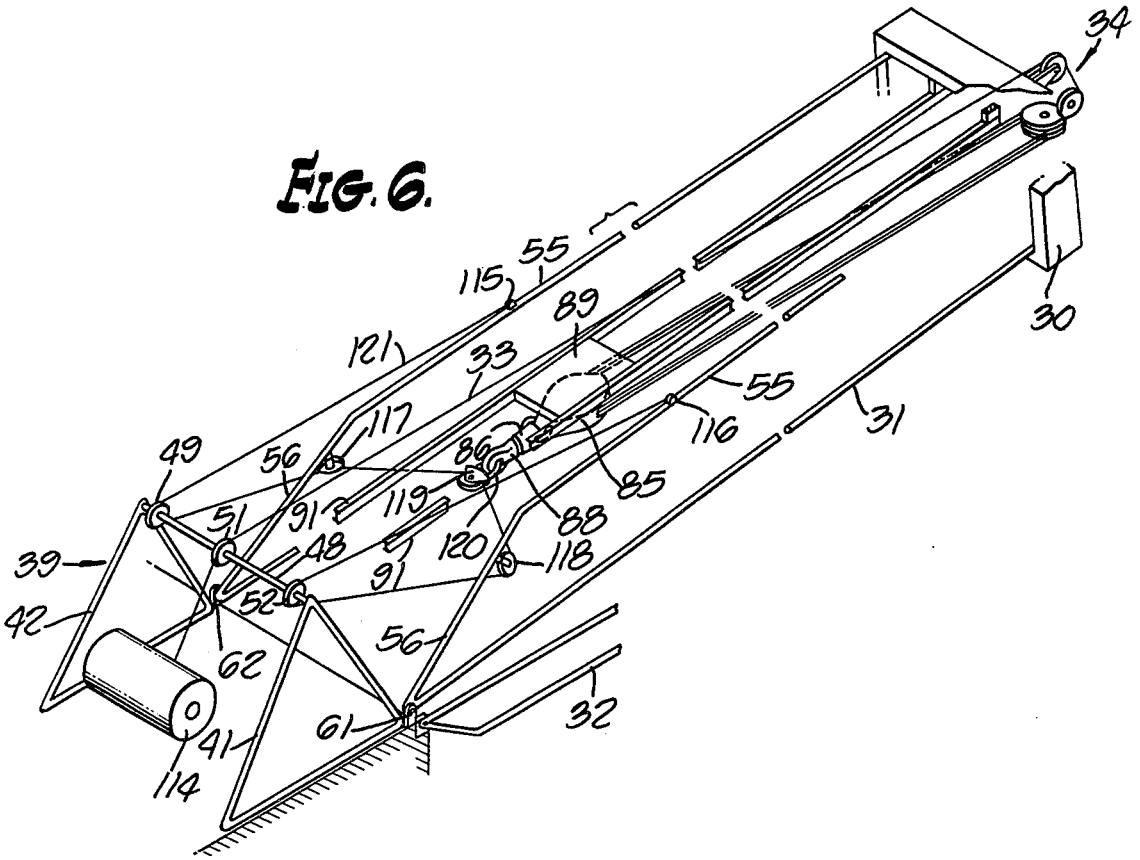
FIG. 6 is a partial schematic view similar to FIG. 2 showing the first stage of the multi-stage mast in reclined condition, and showing rigging for erecting the first stage.

Reference is now made to FIGS. 2, 3 and 6 for showing of equipment for pivoting the first stage 31 between horizontal and vertical positions. The drawworks 28 is provided with the usual powered cable drum 114 for the hoist cable 33 that longitudinally moves the traveling block 85 and the attached hook assembly 86 in the first stage. Each of the rear legs 55, 55 of the first stage has a wire rope anchor 115, 116, and each of the downward extensions 56, 56 is provided with an inwardly projecting sheave 117, 118. A single sheave auxiliary block 119 is attached by a bail 120 to the hook 86. As best seen in FIG. 6, a length of wire rope 121, forming a sling, has one end secured to the anchor 115. The rope passes around the sheave 49 on the A-frame 39, under the sheave 117, through the auxiliary block 119, under the sheave 118, around the sheave 52, and back to the anchor 116, to which it is secured. As seen in FIGS. 2 and 6, the hook assembly 85 is positioned near the bottom of the first stage when the sling is applied.

To raise the first stage to the upright position shown in FIG. 3, the drawworks is operated to reel in the hoist cable 33 and to raise the traveling block, the hook 86, and the auxiliary block 119 in the first stage. As the auxiliary block 119 is raised, the wire rope 121 sling applies a counterclockwise turning movement to the first stage 31 about the axis of the pivot pins 65 and 66 (See FIG. 8) to swing the first stage from its horizontal disposition of FIG. 2 to its vertical disposition of FIG. 3. When the first stage has reached the upright position, it is locked in that position by the locking bolts 69, 69 (See FIG. 10) as previously described. After the first stage has been locked in upright position, the wire rope 121 sling may be removed.

From the foregoing description of the raising of the first stage, it will be obvious that the first stage may be lowered to its horizontal position by reversing the operations performed in raising it. In lowering the first stage, it may be necessary, in the initial increments of movement, to jack it in the counterclockwise direction until its center of gravity passes over its pivot axis, whereupon gravity will urge it towards its horizontal position to which it is gently lowered by braking the drawworks drum 114.

Figure 7:
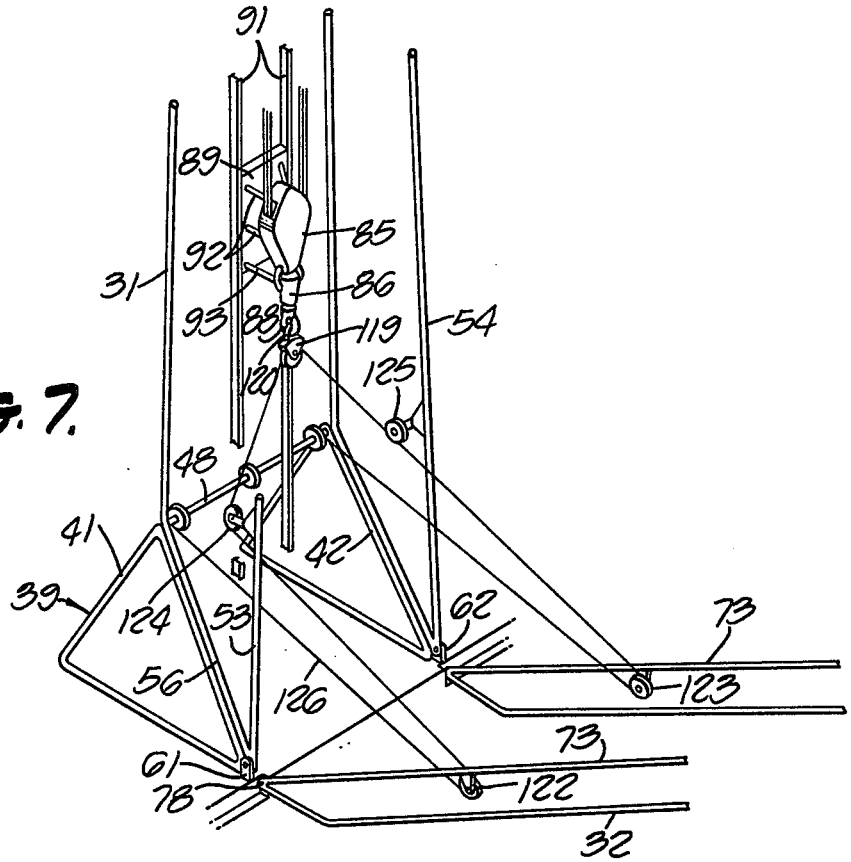
FIG. 7 is a partial schematic view similar to FIG. 4 showing rigging for elevating the second stage.

The raising and lowering of the second stage 32 will now be described with reference to FIGS. 4, 5 and 7. Referring particularly to FIG. 7, one sees that the rear legs 73, 73 of the second stage 32 are provided with sheaves 122, 123, and that the front legs 53, 54 of the first stage 31 have cooperating sheaves 124, 125 mounted thereon. A sling is formed of a wire rope 126, one end of which is secured to the left-hand end of the arbor 48 of the A-frame 39. The rope then passes around the sheaves 122, 124, through the auxiliary block 119, around the sheaves 125, 123, and back to the right-hand end of the arbor 48, where it is secured.

Figure 4:
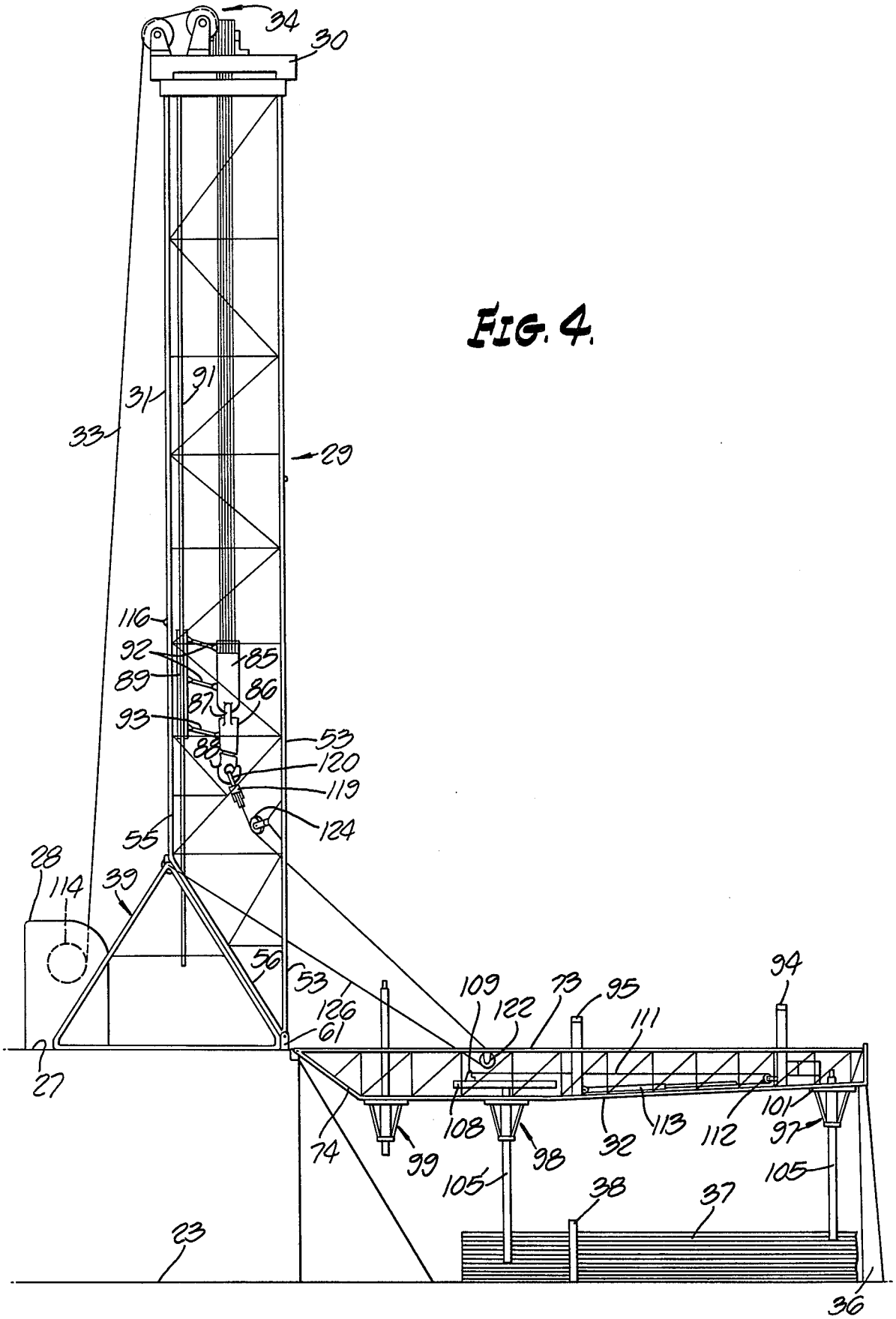
FIG. 4 is a view similar to FIG. 3, but showing certain rigging installed for elevating the second stage.

In order to swing the second stage 32 from its horizontal position, as seen in FIG. 4, to its vertical position, as seen in FIG. 5, the traveling block 85 is lifted by operating the drawworks 28 to wind the cable 33 on the drum 114. The raising of the traveling block also raises the hook assembly 86 and the auxiliary block 119, which pulls the wire rope 126 sling from its position of FIG. 4 to its position of FIG. 5, thereby applying torque to the second stage and swinging it counterclockwise about the pivots 78, 78 (See FIG. 9) into the upright position. The second stage is locked in upright position to the first stage by inserting the locking pins 82 through the side members 81 of the second stage and the front legs 53, 54 of the first stage, as hereinbefore described. After the second stage has been locked upright, the wire rope 126 sling and the auxiliary block 119 may be removed to prepare the mast for drilling.

To lower the second stage from vertical to horizontal position, the steps followed in raising it are merely reversed.

In operation, the drilling vessel, with both stages of the multi-stage mast reclined, as shown in dotted lines in FIG. 1, is towed to the drilling site and anchored thereat. The two stages of the mast are successively raised to their upright positions and locked therein, as hereinbefore described and as shown in FIG. 1. With the mast so erected, the drilling of the well is carried out in the usual way. When round trips are made, as for the purpose of replacing a worn out bit, the drilling string is withdrawn from the well by means of the hoisting equipment carried by the main stage of the mast and is broken down, usually into stands of three singles, and racked in the fingerboard rack, carried by the auxiliary stage, by use of the rackers, also carried by the auxiliary stage.

Following completion of the well and removal of the well pipe from the mast, the two stages of the mast are successively lowered to their horizontal positions, and the drilling vessel is ready to be moved to another location.

From the foregoing description it is seen that the present invention provides a multi-stage, drilling mast that achieves the objects of the invention. While an exemplary form of the invention is herein shown and described, it will be understood that this form is merely illustrative, and that the scope of the invention is best defined in the accompanying claims. Various changes in the illustrated embodiment of the invention will occur to those skilled in the art without departing from the spirit and scope of the invention.

We claim:

1. A multi-stage, well-drilling mast assembly comprising: a platform; a first stage mast; means pivotally mounting said first stage mast on said platform for swinging movements between horizontal and upright positions; means for locking said first stage mast in upright position; a second stage mast; means pivotally mounting said second stage mast on said platform for swinging movements between an upright position adjacent to said first stage mast in its upright position and a horizontal position; and means for locking said second stage mast in upright position; including means for vertically racking a plurality of stands of well pipe in said mast assembly; and power operated racker means carried by said second stage mast for moving a selected stand of well pipe between a position in said racking means and a position on the center line of said mast assembly.

2. A multi-stage, well-drilling mast assembly as defined in claim 1, including hoisting equipment carried by said first stage mast and longitudinally movable therein for raising and lowering well pipe in said mast assembly.

3. A multi-stage, well-drilling mast assembly as defined in claim 2, including an A-frame fixed to said platform adjacent to said first stage mast, and wherein said means for locking said first stage mast in upright position comprises means for releasably connecting said first stage mast to said A-frame.

4. A multi-stage, well-drilling mast assembly as defined in claim 3, wherein said means for locking said second stage mast in upright position comprises means for releasably connecting said second stage mast to said first stage mast.

5. A multi-stage, well-drilling mast assembly as defined in claim 4, including first support means on said platform and spaced from said means pivotally mounting said second stage mast for supporting said second stage mast in its horizontal position.

6. A multi-stage, well-drilling mast assembly as defined in claim 5, including second support means on said platform and spaced from said means pivotally mounting said first stage mast for supporting said first stage mast in its horizontal position.

7. A multi-stage, well-drilling mast assembly as defined in claim 1, wherein said power operated racker means comprises a plurality of vertically spaced racker units, each of which includes a horizontal track mounted on said second stage mast, a carriage movable along said track, an arm reciprocably mounted on said carriage, pipe-gripping means carried by said arm, first motor means for moving said carriage along said track, and second motor means for reciprocating said arm on said carriage.

8. A multi-stage, well-drilling mast assembly as defined in claim 2, wherein said hoisting equipment comprises a crown block mounted on said first stage mast, a traveling block, cable means associated with said crown block and said traveling block for raising and lowering said traveling block, and a hook assembly suspended from said traveling block.

9. A multi-stage well-drilling mast as defined in claim 2, including a frame fixed to said platform adjacent to said first stage mast; sheave means carried by said frame above said means pivotally mounting said first stage mast, and first cable sling means connected to said hoisting equipment, extending around said sheave means, and fixed to said first stage mast, whereby said first stage mast is swung between horizontal and upright positions by moving said hoisting equipment longitudinally in said first stage mast.

10. A multi-stage, well-drilling mast as defined in claim 2, including a frame fixed to said platform adjacent to said first stage mast and extending above said means pivotally mounting said second stage mast, sheave means mounted on said second stage mast, and second cable sling means fixed to said frame above said means pivotally mounting said second stage mast, extending around said sheave means, and connected to said hoisting equipment, whereby when said first stage mast is in its upright position, said second stage mast is swung between horizontal and upright positions by moving said hoisting equipment longitudinally in said first stage mast.

11. A multi-stage, well-drilling mast as defined in claim 2, including means associated with said first stage mast and with said hoisting equipment, and actuated by longitudinal movement of said hoisting equipment in said first stage mast, for swinging said first stage mast between horizontal and vertical positions.

12. A multi-stage well-drilling mast as defined in claim 2, including means associated with said second stage mast and with said hoisting equipment, and actuated by longitudinal movement of said hoisting equipment in said first stage mast when it is in its upright position, for swinging said second stage mast between horizontal and vertical positions.

13. A multi-stage drilling mast as defined in claim 6, including means associated with said second stage mast and with said hoisting equipment, and actuated by longitudinal movement of said hoisting equipment in said first stage mast when it is in its upright position, for swinging said second stage mast between horizontal and vertical positions.

14. Well drilling apparatus comprising a substructure having a front and a back, a mast with an open front side, means hinging the foot of the mast to the substructure on a horizontal axis, means for swinging the mast from a prone position in front of the substructure up to an upright position above the substructure, a pipe racking tower with an open back side for receiving and storing pipe in substantially upright position, means hinging the foot of the tower to the substructure on a horizontal axis in front of said mast hinging means, means for swinging the tower from a prone position in front of the substructure up to an upright position in front of the upright mast, means for holding the mast and tower in said upright position during pipe racking, and a pipe rack mounted inside said tower and accessible from said open front side of the mast for receiving pipe from the mast while the mast and tower are upright, whereby to rack the pipe substantially upright inside the upright tower.

15. Well drilling apparatus according to claim 14, in which the mast and tower in said prone positions are disposed with the tower beneath the mast.

16. Well drilling apparatus according to claim 14, including means supported by said tower for moving stands of pipe from the upright mast into the pipe rack in the upright tower and vice versa.

17. Well drilling apparatus according to claim 16, in which said pipe-moving means are carried upwardly by said tower from its prone position to its upright position.

18. Well drilling apparatus according to claim 14, in which said mast is tapered away from said substructure, and said tower has substantially parallel sides.

19. Well drilling apparatus comprising a substructure having a front and a back, a mast with an open front side, means hinging the foot of the mast to the substructure on a horizontal axis, means for swinging the mast from a prone position in front of the substructure up to an upright position above the substructure, a pipe racking tower with an open back side, means hinging the foot of the tower to the substructure on a horizontal axis in front of and below said mast hinging means, a line attached to the upper side of the prone tower, sheave means up in the upright mast, said line passing over said sheave means and downwardly therefrom, means on said substructure for pulling on said line to swing the tower from a prone position in front of the substructure below the level of the prone position of the mast up to an upright position in front of the upright mast, and means for holding the mast and tower in said upright positions.

20. Well drilling apparatus comprising a substructure having a front and a back, a mast with an open front side, means hinging the foot of the mast to the substructure on a horizontal axis, means for swinging the mast from a prone position in front of the substructure up to an upright position above the substructure, a pipe racking tower with an open back side, means hinging the foot of the tower to the substructure on a horizontal axis in front of and below said mast hinging means, a line attached to the upper side of the prone tower, sheave means up in the upright mast, said line passing over said sheave means, means on said substructure for pulling on said line to swing the tower from a prone position in front of the substructure below the level of the prone position of the mast up to an upright position in front of the upright mast, and means for holding the mast and tower in said upright positions.

* * * * *